United States Patent [19]

Bauer

[11] Patent Number: 4,599,140

[45] Date of Patent: Jul. 8, 1986

[54] METHOD AND APPARATUS FOR CONTROLLING CROSSFLOW IN A DOUBLE COLLECTOR MAIN COKE OVEN BATTERY

[75] Inventor: Edmund G. Bauer, Allentown, Pa.

[73] Assignee: Bethlehem Steel Corporation, Bethlehem, Pa.

[21] Appl. No.: 602,882

[22] Filed: Apr. 23, 1984

[51] Int. Cl.[4] ..... C10B 47/06

[52] U.S. Cl. ..... 201/1; 201/41; 202/256; 202/258; 202/270

[58] Field of Search ..... 201/1, 41; 202/151, 202/256, 258, 270

[56] References Cited

U.S. PATENT DOCUMENTS

| | | | |
|---|---|---|---|
| 3,243,360 | 3/1966 | Wethly | 202/256 |
| 4,158,610 | 6/1979 | Bauer et al. | 201/1 |
| 4,207,145 | 6/1980 | Hatters et al. | 202/270 |
| 4,351,701 | 9/1982 | Bauer | 201/1 |

*Primary Examiner*—Jay H. Woo
*Assistant Examiner*—M. McGurk
*Attorney, Agent, or Firm*—John I. Iverson

[57] ABSTRACT

The flow of gases given off by a coke mass during the production of coke in a coke oven having a coke side collector main and a pusher side collector main is controlled by measuring temperature, pressure, carbon equivalent thickness and rate of carbon formation at selected locations. Electrical signals indicative of the temperature, pressure and carbon measurements are fed to an instrument system and into a computer where the measurements are compared to target values, processed and the resultant information used to control the flow of gases by regulating the gooseneck damper, standpipe control valve and/or the control valves which control collector main pressures.

13 Claims, 11 Drawing Figures

METHOD AND APPARATUS FOR CONTROLLING CROSSFLOW IN A DOUBLE COLLECTOR MAIN COKE OVEN BATTERY

BACKGROUND OF THE INVENTION

In the proper operation of a coke oven having one collector main along the coke side of the oven and another collector main along the pusher side of the oven, gas which is evolved from the coal-coke mass rises into the free space, i.e., the space between the top of the coal-coke mass and the roof of the coke oven, and flows in approximately equal quantities to each collector main. That is, about one-half of the gas quantity flows to the coke side collector main and the other half flows to the pusher side collector main. Such a flow pattern will be present if the pressures in the collector mains are about equal. If the pressures in the mains are slightly different, such a flow pattern may also be present because of an inherent resistance to flow described by the relationship:

$$\Delta P = 8fLQ^2\rho/\pi^2 g_c D^5 \qquad \text{(Equation A)}$$

where:

$\Delta P$ = pressure differential between collector mains
f = friction factor
L = length of flow path
Q = volumetric flow rate
$\rho$ = density of gas
$g_c$ = constant 32.2 ft. lb.m/lb.f sec.$^2$
D = diameter of flow path If the pressure imbalance between the collector mains exceeds the $\Delta P$, inherent resistance to flow, crossflow can occur. As used herein, crossflow is defined as that condition which is present when gas from the higher pressure collector main flows down its standpipe, across the free space, up the other standpipe, and into the other collector main.

In recent times, the standpipe diameter and the free space height of coke ovens have been designed very large in order to prevent pressure buildup in the coke oven and thus reduce coke oven emissions. This increase in area available for gas flow has a profound effect on reducing the inherent resistance to flow because flow path diameter is raised to the fifth power in Equation A, above. For example, if the standpipe diameter is increased from 16 inches to 23 inches for a 45% increase in diameter, the resultant P in Equation A is decreased by 600%. Thus, the larger the flow areas become, the less pressure imbalance it takes between collector mains to cause crossflow. If the flow areas are large enough, the pressure imbalance to cause crossflow may be less than the pressure difference that can be controlled prior to this invention.

Crossflow is generally harmful to a coke oven because it disturbs the thermal conditions in the standpipe and free space, and can also lead to premature failure of the coke oven refractory material. In addition, crossflow can entrain flushing liquor, and the alkalies in the flushing liquor can enhance the growth of the silica brick adjacent the free space by accelerating crystallographic transformation and premature failure of the coke oven brick. Flushing liquor is a weak ammonia liquor generated in the coking process, collected external to the coke oven battery and pumped back through a nozzle to flush the internal surface of the gooseneck, i.e., the pipe that connects the standpipe to the collector main. Such flushing is done in order to prevent the accumulation of condensed tar on the internal surface of the gooseneck. The flushing liquor normally falls down into the collector main when gas flows from the standpipe through the gooseneck to the collector main, However, when crossflow occurs and the gas flows from the collector main through the gooseneck to the standpipe, the flow of gas entrains some flushing liquor and carries this liquor into the oven.

In most coke oven batteries it is desirable to completely eliminate crossflow. However, some coke oven battery designs inherently produce abnormally high temperatures in the roof of the coke ovens. Such high temperatures can result in excessive roof carbon formation. In such case, a controlled amount of crossflow may be desirable to reduce the amount of roof carbon formation.

INCORPORATION BY REFERENCE

This application incorporates by reference the specification and drawings in the following patents: U.S. Pat. No. 4,158,610 issued June 19, 1979 to Inventors Edmund G. Bauer and Glenn Shadle and assigned to Bethlehem Steel Corporation and U.S. Pat. No. 4,351,701 issued Sept. 28, 1982 to Inventor Edmund G. Bauer and assigned to Bethlehem Steel Corporation.

SUMMARY OF THE INVENTION

This invention relates generally to a method and apparatus for controlling the flow of gases in a coke oven and more specifically for controlling crossflow in a double collector main coke oven battery.

It is an object of this invention to closely control crossflow in a double collector main coke oven battery to prolong the life of the refractory material of the battery.

It is another object of this invention to closely control crossflow in a double collector main coke oven battery in order to efficiently produce high quality coke.

It is still another object of this invention to closely control crossflow in a double collector main coke oven battery to control the formation of carbon on the roof of the battery.

The above objects can be obtained by a method and apparatus which positions devices for measuring temperature, pressure, carbon thickness and rate of carbon formation at selected locations in a coke oven battery. Electrical signals from the devices are fed into a computer where the measurements are processed and used to control the flow of gases by regulating the gooseneck dampers, standpipe control valve and/or the control valves which control the pressure in the collector mains.

DETAILED DESCRIPTION OF THE DRAWINGS

Figure 1:
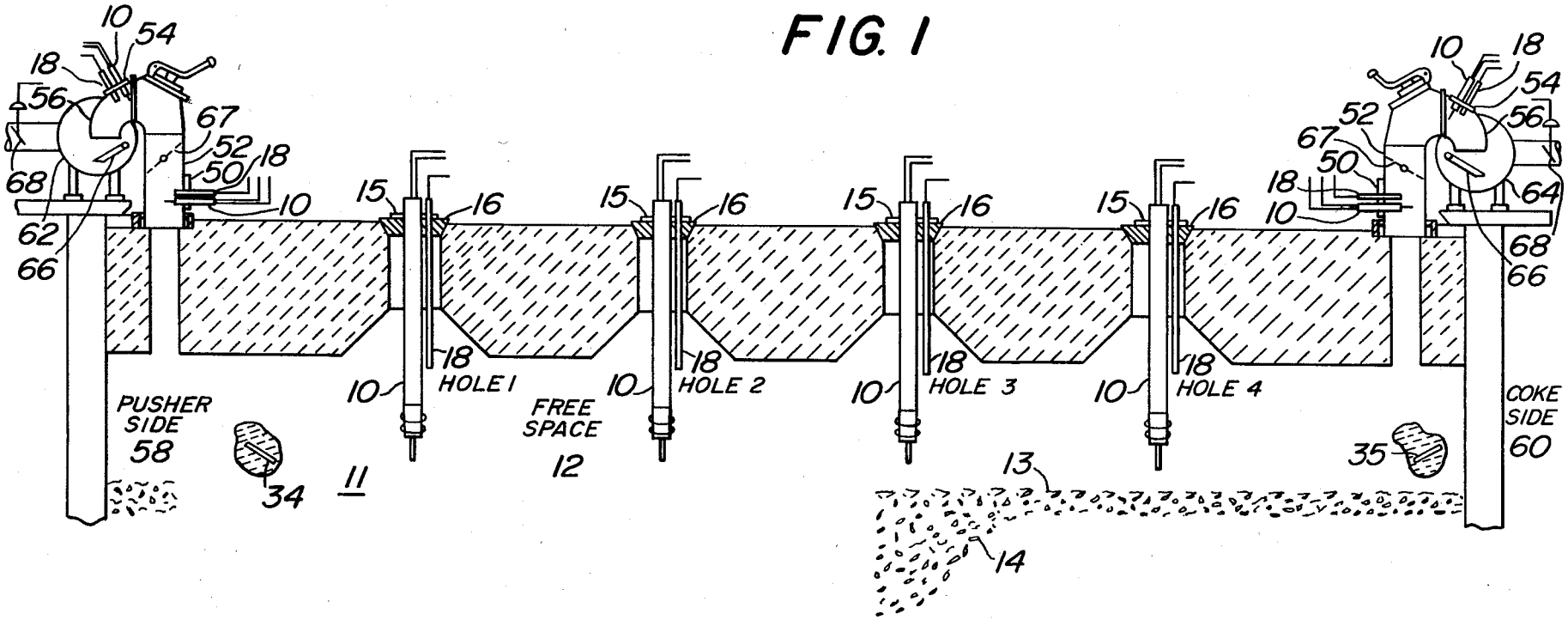
FIG. 1 is a partial cross sectional view of the upper portion of a coke oven.

Referring to FIG. 1, the probe 10 is of the same construction as shown and described in U.S. Pat. No. 4,158,610 and extends through a fitting 15 in charging hole lid at charging holes 1,2, 3 and 4 of coke oven 11. A pressure sampling tube 18 also extends through fitting 15 in charging hole lid 16 at charging holes 1, 2, 3 and 4. The probes 10 and pressure sampling tubes 18 extend into the free space 12 above the coal line 13 of the coal charge 14. A probe 10 and pressure sampling tube 18 may also be placed through a fitting 50 and extend within standpipe 52 and/or placed through a fitting 54 and extend within gooseneck 56. A standpipe 52 and gooseneck 56 are located at both the pusher side 58 and the coke side 60 of the coke oven 11 and are in communication with a pusher side collector main 62 and a coke side collector main 64. A gooseneck damper 66 is located at the point where the gooseneck 56 enters its respective main 62 or 64. A standpipe control valve 67 is located in each standpipe 52. In addition, each collector main, 62 and 64 includes a pressure control valve 68. Thus a probe 10 and a pressure sampling tube 18 may be located in one or more of the following locations, that is, charging holes 1, 2, 3, 4; pusher side gooseneck 56; coke side gooseneck 56; pusher side standpipe 52; coke side standpipe 52; and any other location so that the probe 10 and pressure sampling tube 18 are exposed to the gas released from the coal charge during the coking cycle. Temperature sensing means 34 and 35 are located in the coke oven heating wall adjacent the pusher side 58 and coke side 60, respectively, of the coke oven 11.

Figure 2:
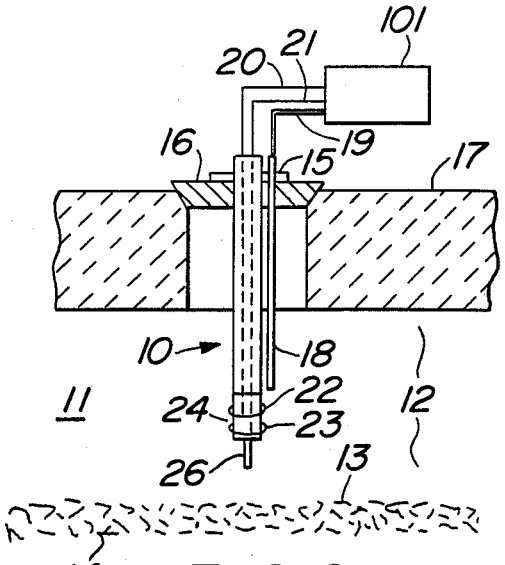
FIG. 2 is a view, partly in section, of one of the charging holes of FIG. 1.

Referring to FIG. 2, probe 10 and pressure sampling tube 18 extend through a fitting 15 in charging hole lid 16 in coke oven roof 17. Lead wires 20 and 21 connect first and second spaced apart wires 22 and 23, respectively, encircling the measurement area 24 of the lower portion of probe 10, with instrument system 101. The wires 22 and 23 serve as electrodes. Tube 19 connects pressure sampling tube 18 to instrument system 101.

Figure 3:
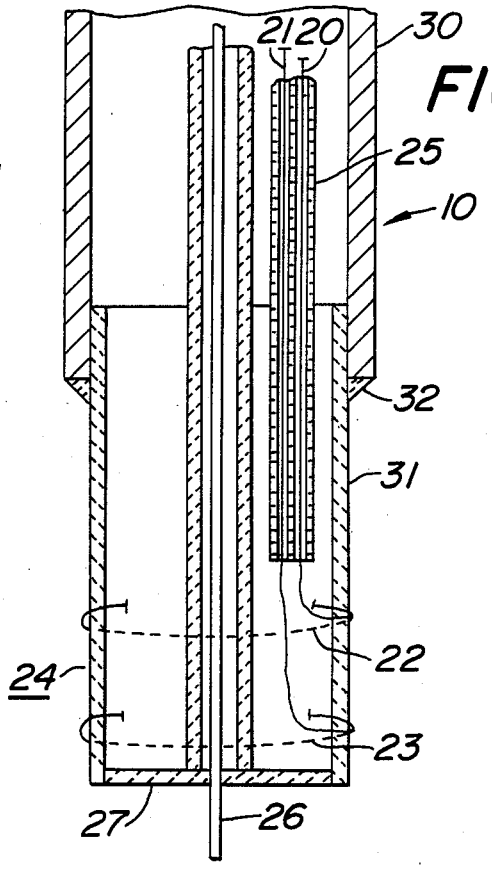
FIG. 3 is an enlarged cross sectional view of the lower end of a carbon probe.

Referring to FIG. 3, the probe 10 is a cylinder and comprises a ½ inch diameter stainless steel tube upper portion 30. The lower portion 31 is a 9.5 mm ceramic tube inserted into the lower end of the stainless steel tube upper portion 30 and is affixed thereto by ceramic cement as at 32 and extending downward therefrom approximately three inches. Spaced apart wires 22 and 23 are seen encircling the ceramic tube 31 in the measurement area 24 of the probe 10 and are connected by lead wires 20 and 21, respectively, to the instrument system 101 as seen in FIG. 2. The lead wires 20 and 21 are protected by a ⅛ inch, 2-hole ceramic insulator 25, each lead wire occupying one of the holes through the tubular insulator 25. A 1/16 inch diameter sheathed type K thermocouple 26 is provided in probe 10 extending therethrough and protruding at the lower end thereof into the coke oven free space slightly to register the temperature of the gases therein. The lower end of the probe is sealed by ceramic cement as at 27. The top of the probe 10 cylinder is also sealed.

The system for measuring the effective thickness of a layer of carbon deposited by a gas in a coke oven comprises the probe 10, signal processing electronics and includes a standard voltage vs. time chart recorder.

The sensor or probe 10 is constructed of materials designed to withstand the highly corrosive, high temperature environment of the coke oven. The two spaced apart wires 22 and 23 located near the end of the probe 10 serve as the electrodes. The area between the electrodes 22 and 23 on the outside surface of the tube 31 comprises the measuring area 24. The electrical resistance between the two electrodes 22 and 23 is in excess of 10 million ohms, until the carbon formation begins. As carbon buildup occurs, the electrical resistance of the sensor decreases proportionately. The effective thickness of the carbon buildup is obtained from the slope of the resistance vs. time curve and other physical parameters described in the equation:

$$t=(\rho l/\pi D\beta T^{x})$$

where:

t=effective thickness of carbon buildup l=gage length of probe

D=diameter of probe $\rho$=electrical resistivity of the carbon $\beta$=measured electrical resistance of probe at time zero T=time X=slope of resistance—time curve.

Figure 4:
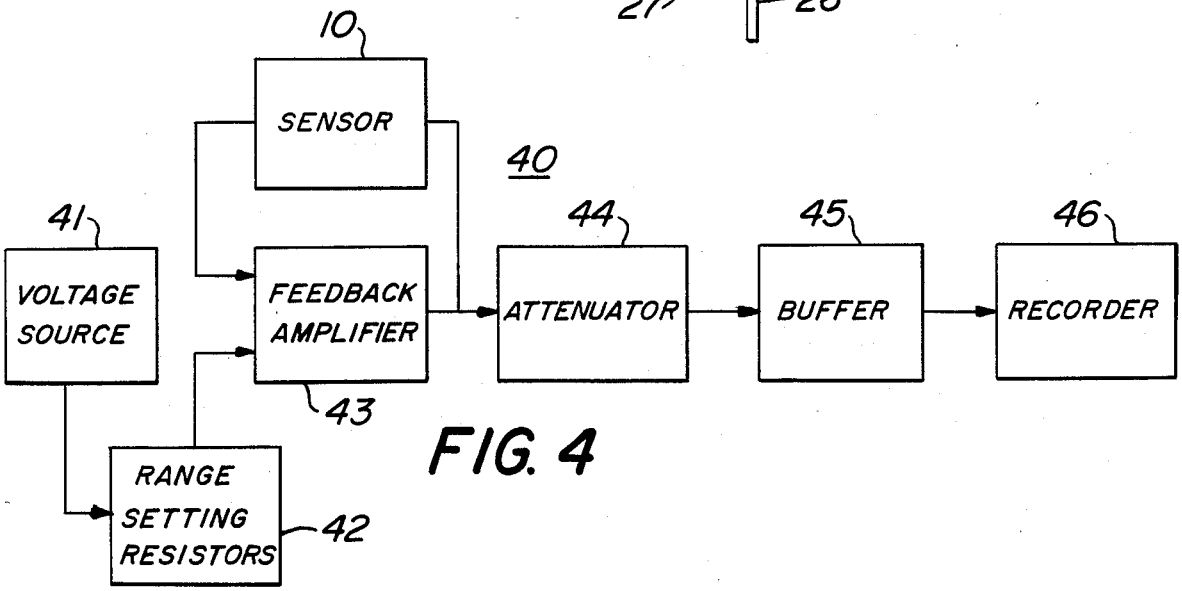
FIG. 4 is a block diagram showing the electronics package of the carbon probe.
Figure 11:
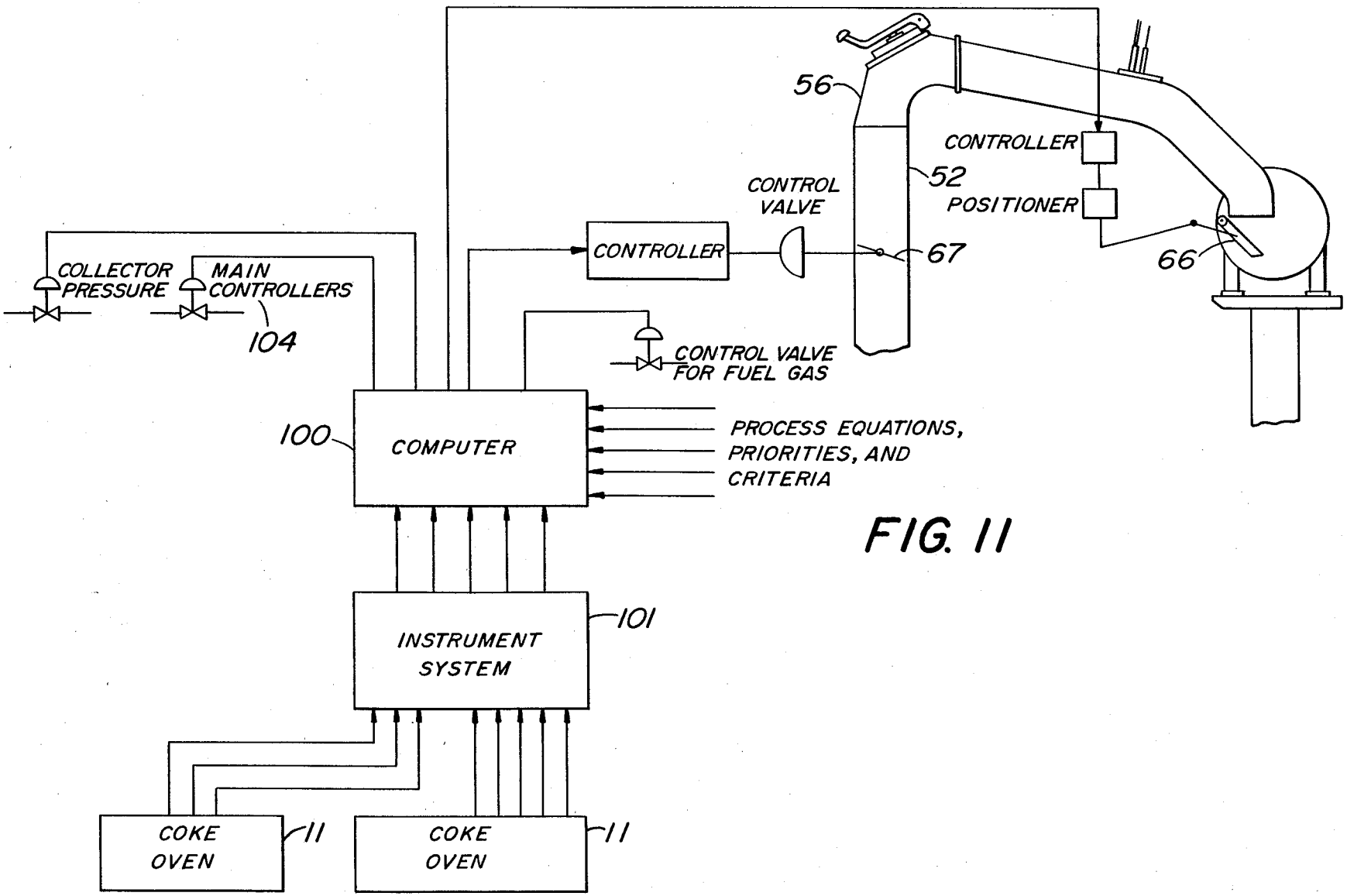
FIG. 11 is a block diagram of the electronic package for this invention.

As shown in FIG. 4, electronics package 40 is a part of the instrument system designated 101 in FIGS. 2 and 11. The electronics package 40 for the sensor 10 accepts the electrical resistance information from the probe 10 and processes it for introduction to the recorder 46 and also for introduction to a computer 100 of FIG. 11, as described below. A 5-volt signal is generated by the voltage source 41 and is supplied to the feedback amplifier 43 through the range setting resistors 42. Three resistors 42 scale the 5-volt signal to provide a decade change of resistance in the system for each resistor step. The 5-volt level is selected to provide adequate signal to reduce the effect of electrical noise in the system. The switching of the range setting resistors 42 can be done manually or under the control of the recorder 46, as the probe or sensor 10 resistance changes decades. The signal input to the feedback amplifier 43 is amplified in proportion to the value of the sensor 10 resistance in the feedback circuit of the amplifier 43. Full scale recorder input results in all ranges when the resistance of the range setting resistor equals the sensor resistance. The purpose of the feedback amplifier 43 is to provide a relatively constant input loading for the recorder 46. The output of the amplifier 43 is then attenuated to the level required for recorder operation, and fed to buffer 45 to match the input impedance of the recorder 46.

The recorder 46 is a standard potentiometric strip chart recorder which provides a continuous record of voltage v. time.

Figure 5:
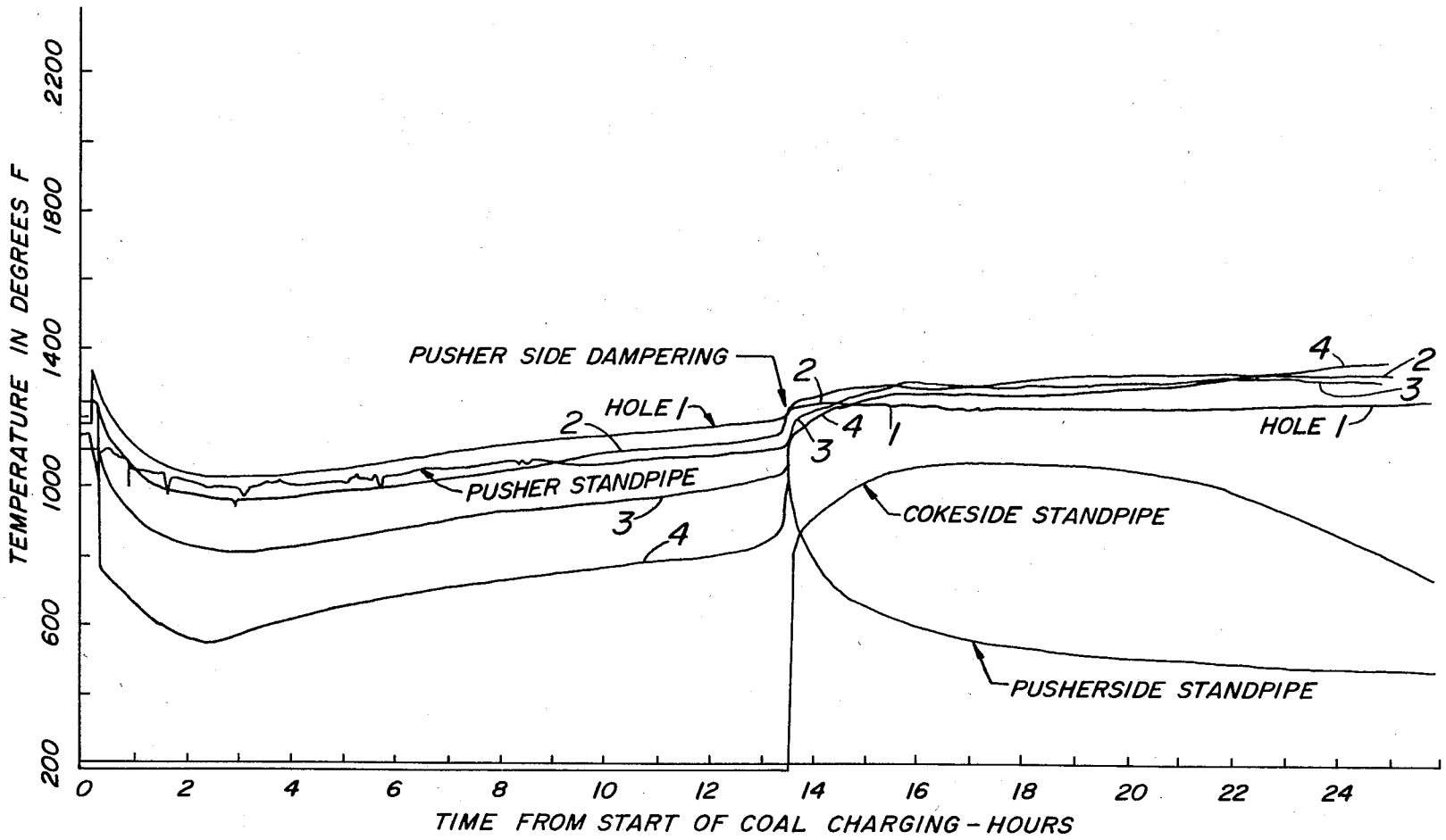
FIG. 5 is a plot of temperature at various locations v. time from the start of coal charging.

FIG. 5 is a plot of temperature in degrees F. at several locations v. time in hours from the start of coal charging into a coke oven. The plot was made during a coking cycle in a 6 meter coke oven battery with a design net coking time of 18 hours. The plot shows the temperatures in degrees F. at charging holes 1, 2, 3 and 4, the coke side standpipe and the pusher side standpipe. This plot clearly shows the detrimental effect of crossflow during a coking cycle of about 26 hours compared to a design time of 18 hours. Note the large temperature gradient between the temperature in the pusher side standpipe and coke side standpipe for time between 0 and about 13.5 hours. This large temperature gradient indicates that cross flow was present from the coke side standpipe to the pusher side standpipe. At about 13.5 hours the pusher side standpipe was dampered, thus physically cutting off the crossflow. Also at that time, the coke side standpipe temperature increased abruptly as the hot gases liberated from the coke mass began to flow up through the coke side standpipe. As the coking cycle continued beyond 13.5 hours the temperature of the coke side standpipe eventually began to decrease as the evolution of gases from the coke mass ceased. Dampering of the pusher side at 13.5 hours eliminated all flow through the pusher side standpipe, and the temperature in that standpipe decreased gradually by heat leak to the atmosphere. Note also the large temperature gradient between the temperatures at the charging holes 1, 2, 3 and 4 due to crossflow at a time between 0–13.5 hours, with hole 1 (the hole nearest the pusher side) having the highest temperature and hole 4 (the hole nearest the coke side) having the lowest temperature. Furthermore the temperatures at all the charging holes at a time between 0–13.5 hours are on the low side due to crossflow. These low temperatures are detrimental to the silica brick of the coke oven. Note that after the dampering at about 13.5 hours the temperatures at all the charging holes increase and the temperature gradient between the temperatures at the charging holes is substantially reduced.

Figure 6:
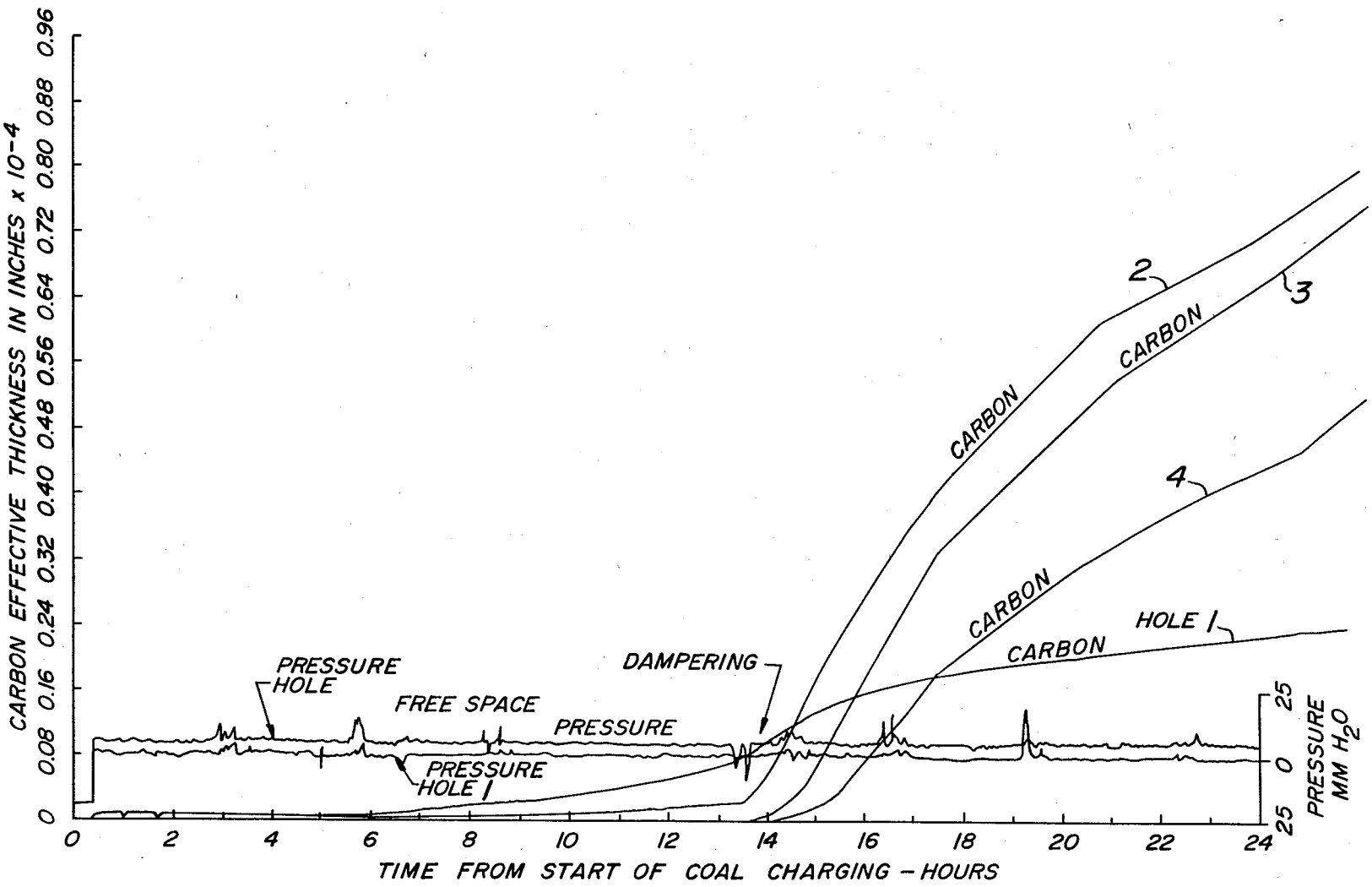
FIG. 6 is a plot of effective thickness of carbon and pressure at various locations v. time from start of coal charging.

FIG. 6 is a plot of carbon effective thickness and pressure at several locations within the freespace of a coke oven v. time from the start of coal charging into the coke oven. The plot was made during the same coking cycle and in the same coke oven as the plot shown in FIG. 5.

In FIG. 6, note that while crossflow was taking place between time 0 and 13.5 hours substantially no carbon was being formed on the carbon probes 10 at holes 1, 2, 3 and 4. As noted for FIG. 5, crossflow was taking place from the coke side to the pusher side or from hole 4 to hole 1 between 0 to 13.5 hours, thus by the time the gases flowed from hole 4 to hole 1 the gas temperature at hole 1 was high enough for a minor amount of carbon to be formed on the carbon probe 10 at hole 1. As in FIG. 5, dampering of the pusher side standpipe took place at about 13.5 hours. As shown in FIG. 5, after such dampering the temperatures at charging holes 1, 2, 3 and 4 increased. Thus, as shown in FIG. 6, carbon formation increased at the carbon probe of holes 1, 2, 3 and 4. Note that the carbon effective thickness curves are still rising at the end of the coking cycle, indicating that the coal charge is not fully coked because the freespace temperature was too low prior to dampering.

Figure 7:
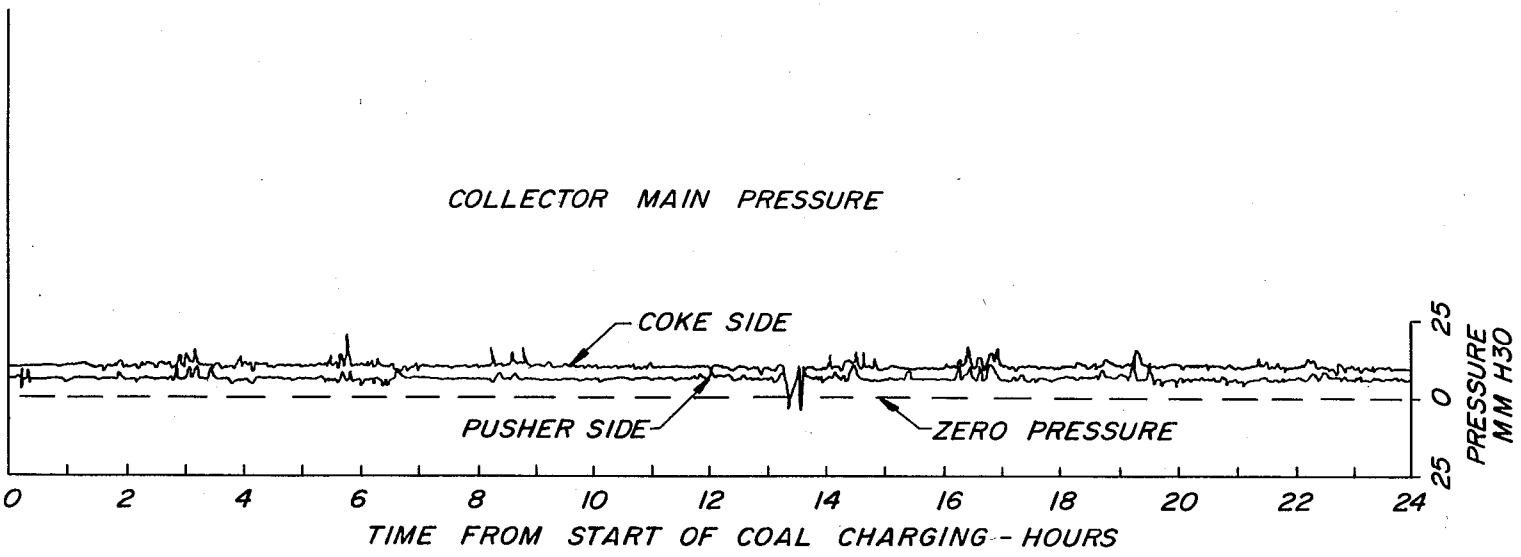
FIG. 7 is a plot of coke side and pusher side collector main pressure v. time from start of coal charging.

FIG. 7 is a plot of collector main pressure at the pusher side collector main and the coke side collector main v. time from start of coal charging. This plot was made during the same coking cycle and in the same coke oven battery as the plots shown in FIGS. 5 and 6. The coke side collector main is at a positive pressure of about 10 mm of water while the pusher side collector main is at a positive pressure of about 5 mm of water. Thus there is a pressure difference of about 5 mm of water between the coke side and the pusher side collector mains. This pressure difference is sufficient to cause crossflow in an undampered oven.

Figure 8:
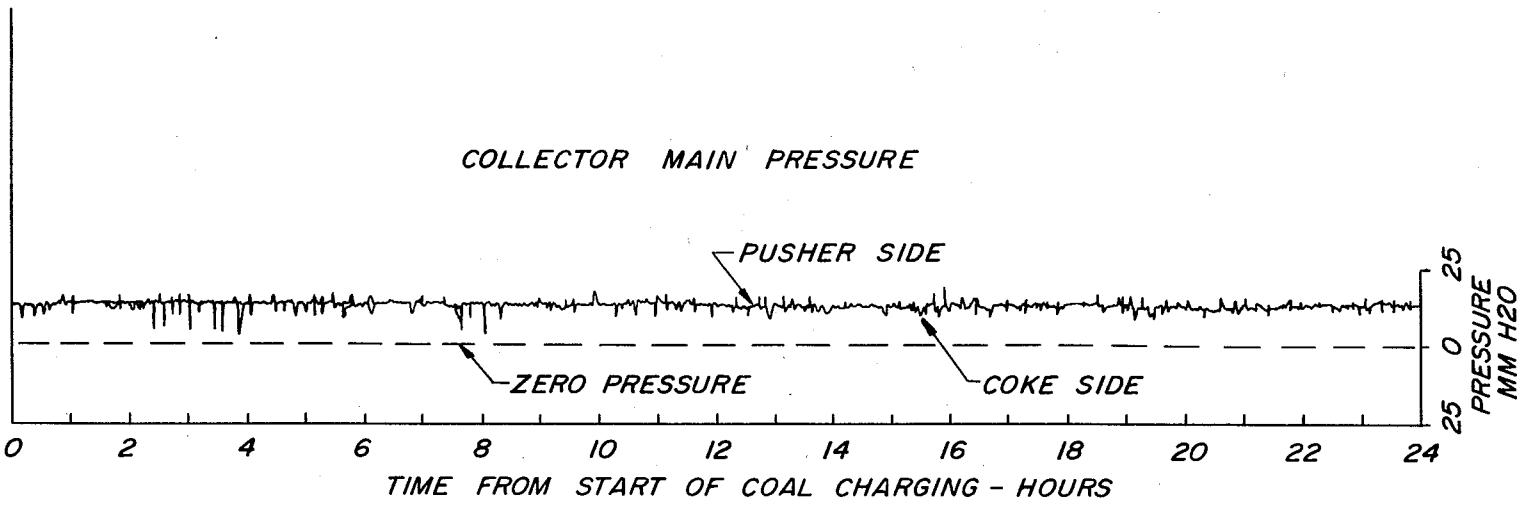
FIG. 8 is a plot of coke side and pusher side collector main pressure v. time from start of coal charging.

FIG. 8 is a plot of collector main pressure at the pusher side collector main and the coke side collector main v. time from start of coal charging. This plot was made during a different coking cycle than the coking cycle of FIGS. 5, 6 and 7 and is indicative of well regulated collector mains.

Figure 9:
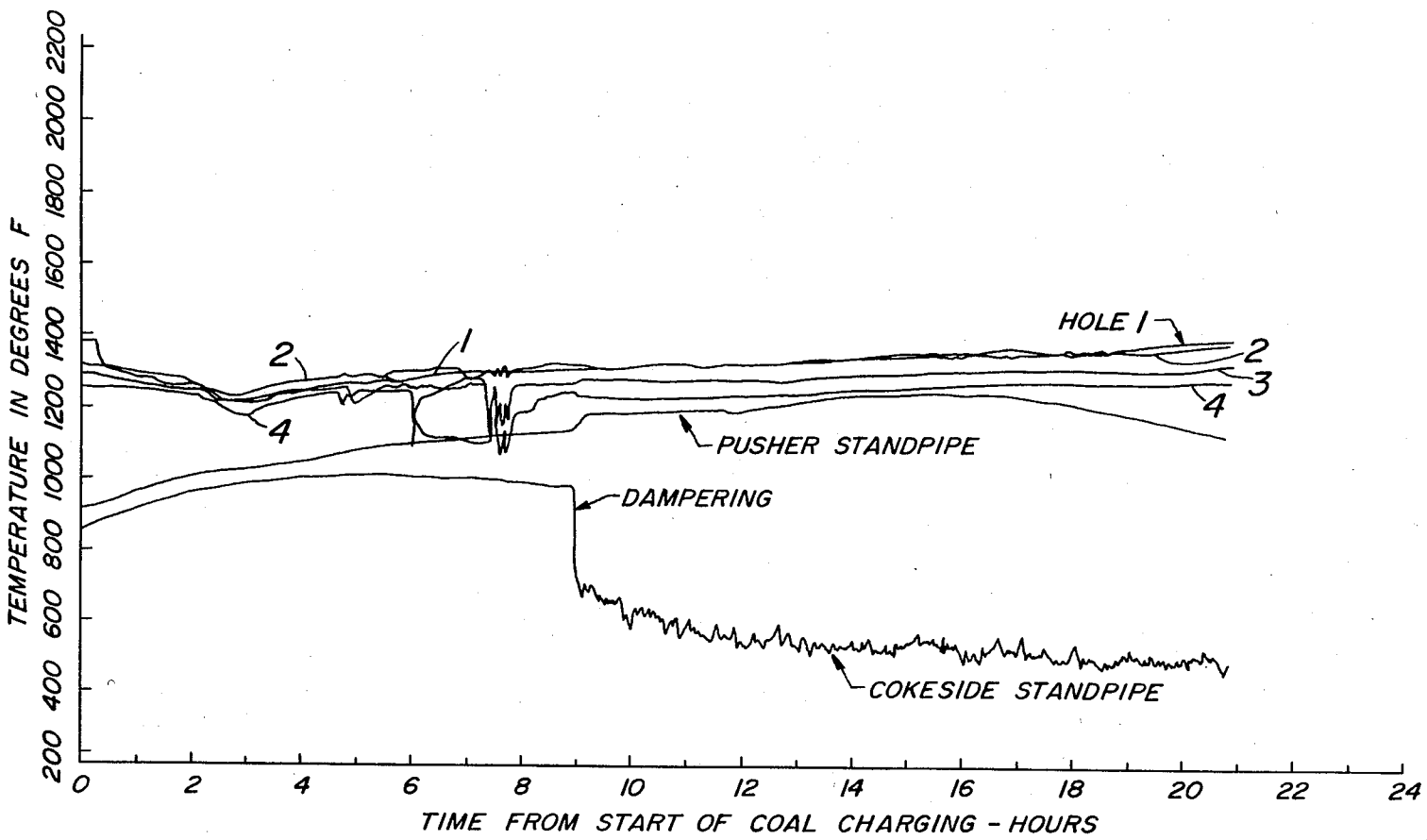
FIG. 9 is a plot of temperature at various locations v. time from start of coal charging.
Figure 10:
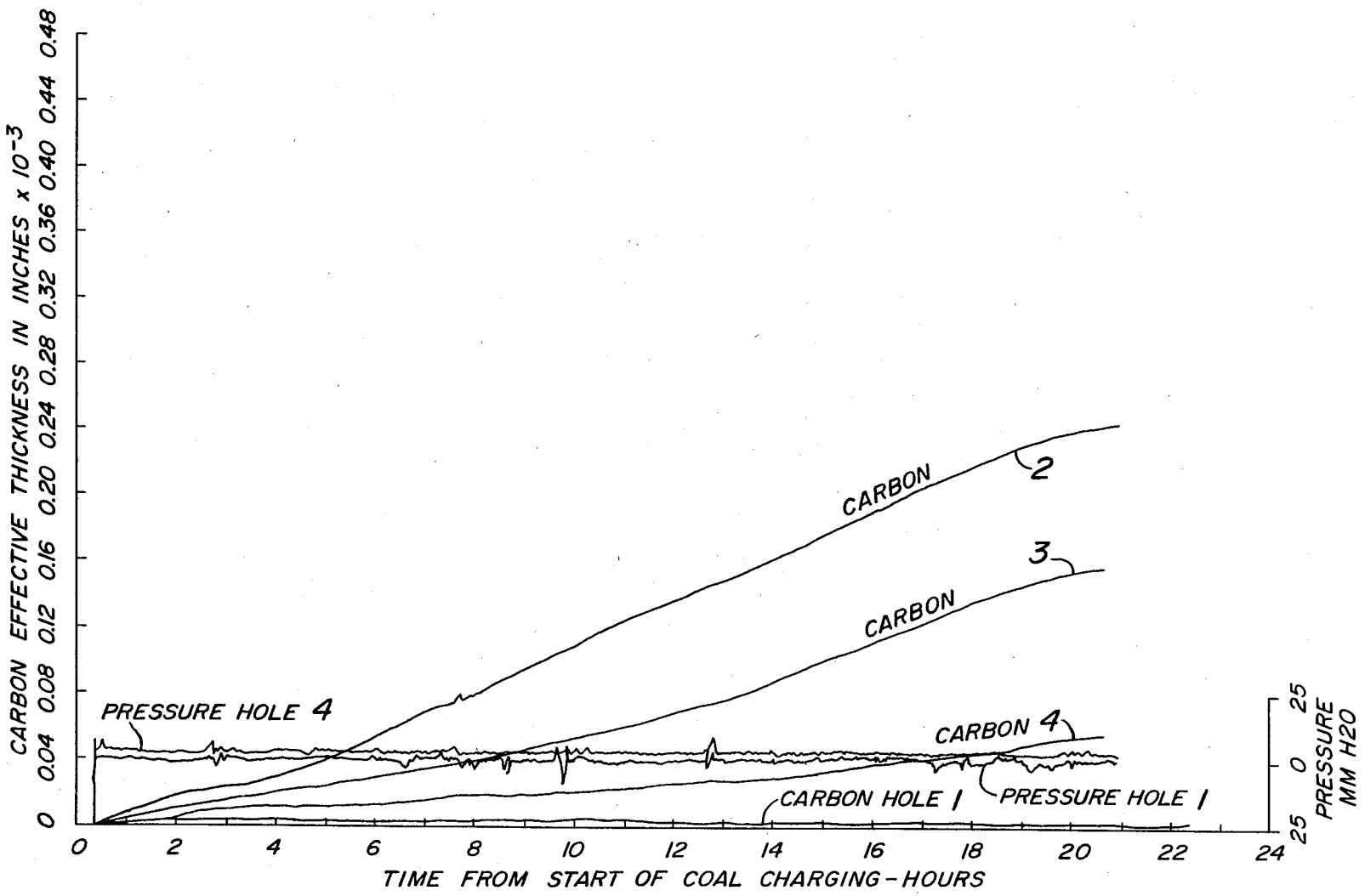
FIG. 10 is a plot of effective thickness of carbon at various locations v. time from start of coal charging.

FIG. 9 is a plot of temperature at charging holes 1, 2, 3 and 4, and the coke side and pusher side standpipes v. the time from start of coal charging. The data shown in FIG. 9 and FIG. 10 were taken in the same coke oven of a 6 meter coke oven battery as that shown in FIGS. 5, 6 and 7. In the coking cycle of FIGS. 9 and 10 there was no substantial crossflow, as shown in FIG. 9 by the absence of any substantial temperature gradient between the temperatures at the freespace of charging holes 1, 2, 3 and 4. At about 9 hours into the coking cycle the coke side standpipe was dampered. Dampering of ovens on coke side of the battery led to a more favorable gas flow distribution than was present with the pusher side dampering of FIGS. 5, 6 and 7. Since more gas was caused to flow to the pusher side collector main with this coke side dampering pattern, the gas flowing to each collector main was sufficient so that the pressure control regulators of both mains could function within their control range. Thus as shown in FIG. 10, which is a plot of carbon effective thickness and pressure v. time from start of coal charging, the pressure difference across the ovens, i.e., from hole 1 to hole 4, is less than the pressure difference shown in FIG. 6. In addition, since there was no significant crossflow, the oven freespace was not chilled and as shown in FIG. 10, carbon began to form on the carbon probe 10 from the beginning of the coking cycle.

The above description of FIGS. 5–10 point out the relationship of temperature, pressure, and carbon formation to crossflow in a double collector main coke oven, and, in addition, the role dampering plays in regards to crossflow.

Referring to FIG. 11, electrical signals travel from coke ovens 11 to an instrument system 101 which includes the electronics package 40 of FIG. 4. The electrical signals are indicative of measured values of freespace and standpipe carbon effective thickness and rate of carbon formation; heating wall, freespace and standpipe temperature; freespace and collector main pressure; and damper and valve positions. The instrument system 101 may be located at the coke oven battery and be readily available to provide date to the operating personnel. From the instrument system 101, the signals travel through lines to a computer 100 where the signals are processed in accordance with the process equations, priorities and criteria, which have been loaded into the computer 100. After processing, signals are generated by the computer 100 to position the collector main pressure controllers 104, the standpipe control valve 67, the standpipe damper 66, and the fuel gas control valve which controls the fuel being supplied to heat the coke oven.

The following are the process equations, priorities and criteria which are introduced into the computer 100:

1. X=Temperature Gradient Across Standpipes, where $X = T_{cssp} - T_{pssp}$

T=Temperature in °F.

cssp=Coke side standpipe
pssp=Pusher side standpipe
2. $|X|=|T_{cssp}-T_{pssp}|$
| |=absolute value
3. $|X|_{max}=50°$ F., where
max=maximum
4. W=Time Into Coke Cycle When Damper Should Be Closed. Typical time=0.7 to 0.8×net coking time.
5. Y=Temperature Gradient Across Freespace
$Y=T_H-T_1$, where
H=Highest Numbered Charging Hole
1=Charging Hole No. 1
6. Z=Temperature Gradient Along Heating Walls of Coke Oven, Coke Side to Pusher Side
$Z=T_{N-2}-T_2$ where subscripts refer to flue number
N=number of flues in Heating Wall
7. Carbon Effective Thickness Curve
C=function of (T,B,A,K,M)
C=Carbon Effective Thickness
T=Free Space Temperature
B=Coal Blend in Coke Oven
A=Type of Heating System
K=Fuel Gas Heating Value
M=Time
7A. $C_{max}=0.5\times10^{-3}$ Effective Thickness in Inches
8. $R=dC/dM$
R=Rate of Carbon Formation
d=differential
8A. $R_{max}=1\times10^{-4}$ Effective Inches Per Hour.
9. V=Collector Main Pressure Differential
$V=P_{cscm}-P_{pscm}$
P=Pressure in mm of $H_2O$
cscm=Coke side collector main
pscm=Pusher side collector main
10. $|V|_{max}=1$ mm $H_2O$
11. $6<J<12$ where
J=minimum allowable collector main pressure
12. E=Time to Repeat Process Equations
5 minutes<E<15 minutes
13. Closing of Standpipe Valves or Dampers
F=function of (X,Y)
14. Collector Main Pressure Controllers
G=function of (M,V)

The above process equations initially look for a difference in temperature between the two standpipes of the coke oven, Equation 1. If a temperature difference does exist the difference is compared against the maximum temperature difference placed in the computer, Equation 3. The freespace temperature gradient is also determined for a gradient in the same direction as the standpipe temperature difference, Equation 5. If the freespace temperature gradient is similar to the heating wall temperature gradient, Equation 6, i.e. Y=Z and |X|max>50° F., a signal is sent to the coke oven operator to check for premature dampering. Equation 4. On the other hand if electric sensors are installed on the dampers, the computer will know whether or not premature dampering has taken place and a corrective signal will be sent to the dampers. If the freespace temperature gradient is greater than the heating wall gradient Y>Z the carbon effective thickness curve is checked against the carbon effective thickness-time, and carbon effective thickness rate-time relationship, Equations 7, 7A, 8 and 8A. If crossflow is indicated by above, the collector main pressure signals are compared for pressure differential and pressure level, Equations 9 and 11, beyond a maximum allowable value, Equation 10. If the collector main pressures are unacceptable, corrective signals are sent to the collector main pressure controllers, Equation 14. Thereafter, the freespace temperature gradient, Y, and standpipe temperature gradient, X, and carbon signals are again checked after a predetermined time period, Equation 12. If crossflow has not been adequately reduced as evidenced by such signals, corrective signals are sent to the control valve in the standpipe or to the controller for the damper, Equation 13. The above process is repeated throughout the coking cycle until the carbon probes indicate the end of devolatilization, as disclosed in U.S. Pat. No. 4,351,701.

The following is the logic under which the above system functions. The computer first determines if there is a temperature difference of more than about 50° F. between the standpipes. If there is such a temperature difference, the computer next looks to the temperature difference between the coke side and the pusher side fee space and the temperature difference along the heating wall between coke side and the pusher side. If the temperature difference in in the freespace is the same as the temperature difference along the heating wall, the freespace temperature difference is caused by heating and not cross flow. Furthermore, the high temperature difference between the standpipes means that one of the standpipe's control valves and/or gooseneck dampers are closed when it should not be closed. Thus a check of the position of the dampers and control valves is made and the damper and control valve opened. Now if the freespace temperature difference is greater than the heating wall temperature difference, crossflow is present. Next the carbon formation is measured to confirm the presence of crossflow and to estimate how severe crossflow is. Next the pressure difference between collector mains is measured and if the pressures in the mains are not in balance, the collector main control valves are adjusted. Finally, the gooseneck dampers or control valves in the standpipes can be trimmed to eliminate crossflow.

As noted above, this invention strives to keep the freespace temperature difference at 50° F. or less. This value is based primarily on operating experience and the fact that it is highly desirable to stay above 1200° F. in the freespace in order to have the proper thermal expansion of the silica brick of the coke oven. If a temperature difference of 100° F. were selected it may not allow for the proper thermal expansion of the brick, whereas a temperature difference of much less than 50° F. would place unnecessary constraints on the control system.

It has been found that 1 mm of water is the least pressure difference between the collector mains which current state of the art industrial quality pressure controllers can maintain. The 6 to 12 mm of water pressure range referred to above was determined by practical coke oven battery operating considerations. If the pressure is below 6 mm of water there may be a negative pressure in the bottom of the coke oven which causes air to pass into the oven and creates damaging hot spots in the oven. If the pressure exceeds 12 mm of water the oven will be subject to a back pressure which may cause leaks out of the coke oven doors and charging hole lids, resulting in air pollution.

While my invention has been described in considerable detail, I do not wish my invention to be limited narrowly to the specific details disclosed. It will be apparent that various modifications may be made to my invention as described without departing from the spirit and scope of my invention.

I claim:

1. A method of controlling the crossflow of gases given off by a coal mass during the production of coke in a coke oven having a coke side collector main and a pusher side collector main comprising the steps of:

(a) determining the temperature difference between the temperature in the coke side standpipe and the temperature in the pusher side standpipe, (b) determining the temperature difference between the temperature in the freespace adjacent the coke side of the coke oven and the temperature in the freespace adjacent the pusher side of the coke oven, (c) determining the temperature difference between the temperature of the heating wall of the coke oven adjacent the coke side of the coke oven and the temperature of the heating wall of the coke oven adjacent the pusher side of the coke oven, and (d) opening the coke side standpipe control valve and gooseneck damper and the pusher side standpipe control valve and gooseneck damper, if they are not in the open position, if the temperature difference of step (b) is substantially the same as the temperature difference of step (c) and the temperature difference of step (a) is greater than about 50° F. in order to control crossflow.

2. The method of claim 1 including the further steps of:

(e) measuring the carbon effective thickness and rate of carbon formation at the following locations: coke side standpipe, pusher side standpipe, freespace adjacent coke side of coke oven and freespace adjacent pusher side of coke oven, (f) comparing the measured values of step (e) with corresponding target values for carbon effective thickness and rate of carbon formation, (g) if the measured values of step (e) are not substantially the same as the target of step (f), determining the pressure difference between the pressure in the coke side collector main and the pressure in the pusher side collector main, (h) if the pressure difference of step (g) is greater than about 1 mm. of water, activating pressure controllers in the collector mains to reduce the pressure difference of step (g) to about 1 mm. of water or less while maintaining a pressure greater than about 6 mm. of water but less than 12 mm. of water in each collector main in order to control crossflow.

3. The method of claim 2 wherein steps (a) through (h) are periodically repeated.

4. The method of claim 2 including the further step of:

(i) closing the gooseneck damper on the standpipe having the higher temperature until the temperature difference of step (a) is less than about 50° F. in order to control crossflow.

5. The method of claim 4 including the further step of:

(j) closing the standpipe control valve on the standpipe having the higher temperature until the temperature difference of step (a) is less than about 50° F. in order to control crossflow.

6. A method of controlling crossflow of gases given off by a coal mass during the production of coke in a coke oven having a coke side collector main and a pusher side collector main comprising the steps of:

(a) measuring the temperature (Tcssp) of said gas in the coke side standpipe and the temperature (Tpssp) of said gas in the pusher side standpipe, (b) determining the temperature difference (ΔTsp) between Tcssp and Tpssp, (c) if ΔTsp is greater than about 50° F., measuring the temperature (Tcsfs) of said gas in the freespace adjacent the coke side of said coke oven and the temperature (Tpsfs) of said gas in the freespace adjacent the pusher side of said coke oven, (d) determining the temperature difference (ΔTfs) between Tcsfs and Tpsfs, (e) measuring the temperature (Tcshw) of the heating wall of said coke oven adjacent the coke side of said coke oven and the temperature (Tpshw) of said heating wall adjacent the pusher side of said coke oven, (f) determining the temperature difference (ΔThw) between Tcshw and Tpshw, (g) if ΔTfs is substantially the same as ΔThw and ΔTsp is greater than about 50° F., the coke side standpipe control valve and gooseneck damper and the pusher side standpipe control valve and gooseneck damper, if not in the open position are moved to the open position, (h) if ΔTfs is greater than ΔThw, measuring carbon data curve comprising carbon effective thickness (C) and rate of carbon formation (R) at the following locations: coke side standpipe, pusher side standpipe, freespace adjacent the coke side, and freespace adjacent the pusher side and comparing C and R against a target carbon effective thickness (SC) and a target rate of carbon formation (SRC) for such locations with SC and SRC based on freespace temperature, coal blend, type of heating system, fuel gas heating value, and time from the start of the coking cycle, (i) if C and R are not substantially the same as SC and SRC, respectively, measuring the pressure (Pcscm) in the coke side collector main and the pressure (Ppscm) in the pusher side collector main and determining the pressure difference (ΔPcm) between Pcscm and Ppscm, (j) if ΔPcm is greater than 1 mm. of water, activating pressure controllers in the collector mains to reduce ΔPcm to about 1 mm. of water or less while maintaining a pressure greater than about 6 mm. of water but less about 12 mm. of water in each collector main, and (k) periodically repeating the above steps beginning with step (a) above until ΔPcm is within 1 mm. of water and substantially steady in order to control crossflow.

7. The apparatus for controlling crossflow of gases given off by a coal mass during the production of coke in a coke oven having a coke side collector main and a pusher side collector main comprising:

(a) means for measuring the temperature difference between the temperature in the coke side standpipe and the pusher side standpipe, (b) means for measuring the temperature difference between the temperature in the freespace adjacent the coke side of the coke oven and the temperature in the freespace adjacent the pusher side of the coke oven, (c) means for measuring the temperature difference between the temperature of the heating wall of the coke oven adjacent the coke side of the coke oven and the temperature of the heating wall of the coke oven adjacent the pusher side of the coke oven, and (d) means to open the standpipe control valves and gooseneck dampers, if the dampers are not open, if the means of paragraphs (b) and (c) measure a temperature difference substantially the same and the means of paragraph (a) measures a temperature difference greater than about 50° F.; wherein the said means to open is in operative conjunction with the said means of paragraphs (a), (b), and (c).

8. The apparatus of claim 7 further comprising:

(e) means to measure carbon effective thickness and rate of carbon formation at the following locations: coke side standpipe, pusher side standpipe, freespace adjacent the coke oven and freespace adjacent the pusher side of coke oven, (f) means to compare the measured values of paragraph (e) with corresponding target values for carbon effective thickness and rate of carbon formation, (g) means to determine the pressure difference between the pressure in the coke side collector main and the pressure in the pusher side collector main, when the measured values of paragraph (e) are not substantially the same as the target values of paragraph (b);

wherein the said means to determine the pressure difference is in operative conjunction with the means of paragraphs (e) and (b), (h) means to activate pressure controllers in the collector mains to reduce the pressure difference of paragraph (g) to about 1 mm. of water or less while maintaining a pressure greater than about 6 mm. of water but less than 12 mm. of water in each collector main when the pressure difference of paragraph (g) is greater than about 1 mm. of water;

wherein the said means to activate pressure controllers is in operative conjunction with the means of paragraph (g).

9. The apparatus of claim 8 further comprising:

(i) means to close the gooseneck damper on the standpipe having the higher temperature until the temperature difference of paragraph (a) is less than about 50° F.;

wherein the said means to close the gooseneck damper is in operative conjunction with paragraph (a).

10. The apparatus of claim 8 further comprising:

(j) means to close the standpipe control valve on the standpipe having the higher temperature until the temperature difference of paragraph (a) is less than about 50° F.;

wherein the said means to close the standpipe control valve is in operative conjunction with paragraph (a).

11. Apparatus for controlling the crossflow of gases given off by a coal mass during the production of coke in a coke oven having a coke side collector main and a pusher side collector main comprising:

(a) means to measure the temperature (Tcssp) of said gas in the coke side standpipe and the temperature (Tpssp) of said gas in the pusher side standpipe, (b) means to determine the temperature difference (ΔTsp) between Tcssp and Tpssp, (c) means to measure the temperature (Tcsfs) of said gas in the freespace adjacent the coke side of said coke oven and the temperature (Tpsfs) of said gas in the freespace adjacent the pusher side of side coke oven, (d) means to determine the temperature difference (ΔTfs) between Tcsfs and Tpsfs, (e) means to measure the temperature (Tcshw) of the heating wall of said coke oven adjacent the coke side of said coke oven and the temperature (Tpshw) of said heating wall adjacent the pusher side of said coke oven, (f) means to determine the temperature difference (ΔThw) between Tcshw and Tpshw, (g) means to open the coke side standpipe control valve and gooseneck damper and pusher side standpipe control valve and gooseneck damper, if not in the open position, when ΔTfs is about the same as ΔThw and ΔTsp is greater than about 50° F.;

wherein the said means to open is in operative conjunction with the means to measure $\Delta T_{fs}$, $\Delta T_{hw}$ and ΔTsp, (h) means to measure carbon data curve including carbon effective thickness (C) and rate of carbon formation (RC) at the following locations: coke side standpipe, pusher side standpipe, freespace adjacent the coke side and freespace adjacent the pusher side and to compare C and RC against a target carbon effective thickness (SC) and a target rate of carbon formation (SRC) for such locations with SC and SRC based on freespace temperature, coal blend, type of heating system, fuel gas heating value and time from the start of the coking cycle, (i) means to measure the pressure (Pcscm) in the coke side collector main and the pressure (Ppscm) in the pusher side collector main when C and R are are not about the same as SC and SRC;

wherein the said means to measure the pressure is in operative conjunction with the means to measure C,R,SC and SRC, (j) means to determine the pressure difference (ΔPcm) between Pcscm and Ppscm, and (k) means to activate pressure controllers in the collector mains to reduce ΔPcm to about 1 mm. of water or less while maintaining a pressure greater than about 6 mm. of water but less than about 12 mm. of water in each collector main.

12. The apparatus of claim 11 further comprising:

(l) means to close the gooseneck damper on the standpipe having the higher temperature until ΔTsp is about 50° F. or less;

wherein the said means to close the gooseneck damper is in operative conjunction with the means to determine ΔTsp.

13. The apparatus of claim 11 further comprising:

(m) means to close the control valve on the standpipe having the higher temperature until ΔTsp is about 50° F. or less;

wherein the said means to close the control valve is in operative conjunction with the means to determine ΔTsp.

* * * * *